United States Patent [19]

Mayer et al.

[11] 4,354,365

[45] Oct. 19, 1982

[54] PERMUTATION LOCK

[75] Inventors: Siegfried Mayer, Münster-Wolbeck; Ludger Henrichmann, Münster, both of Fed. Rep. of Germany

[73] Assignee: Aug. Winkhaus, Telgte, Fed. Rep. of Germany

[21] Appl. No.: 236,020

[22] Filed: Feb. 19, 1981

Related U.S. Application Data

[63] Continuation of Ser. No. 73,208, Sep. 7, 1979, abandoned.

[30] Foreign Application Priority Data

Sep. 14, 1978 [DE] Fed. Rep. of Germany ..... 2840098

[51] Int. Cl.[3] ..... E05B 37/02; E05B 37/06

[52] U.S. Cl. ..... 70/30; 70/312; 70/316

[58] Field of Search ..... 70/23, 30, 312, 315, 70/316, 317, 318

[56] References Cited

U.S. PATENT DOCUMENTS 1,410,033 3/1922 Pass .

FOREIGN PATENT DOCUMENTS 1703190 2/1972 Fed. Rep. of Germany .
593018 10/1947 United Kingdom .

*Primary Examiner*—Robert L. Wolfe
*Attorney, Agent, or Firm*—Toren, McGeady & Stanger

[57] ABSTRACT

In a permutation lock, a closing bolt is secured within a bore in the lock housing. Setting wheels on the lock housing can be rotated to a position representing the combination of the lock for releasing the closing bolt. Each setting wheel consists of an inner ring and an outer ring which are interconnected for rotational movement as a unit. The setting wheels extend between stops on the housing. One of the stops is displaceable in the axial direction so that the outer rings can be displaced axially relative to the inner rings for changing the combination of the permutation lock.

14 Claims, 2 Drawing Figures

PERMUTATION LOCK

This is a continuation of application Ser. No. 073,208 filed on Sept. 7, 1979, abandoned.

SUMMARY OF THE INVENTION

The present invention is directed to a permutation lock consisting of a lock housing with an axially extending bore into which a closing bolt can be inserted. Radial openings extend through the housing and contain radially displaceable locking pins which are engageable within locking pin recesses in the closing bolt. Setting wheels are rotatably positioned on the housing and can be rotated independently of one another. The setting wheels can be positioned representing the combination of the lock so that the closing bolt can be removed from the bore in the housing. When the setting wheels are displaced from the position representing the combination, the locking pins engage recesses in the closing bolt securing it within the housing. When the setting wheels are moved into the position representing the combination, the locking pins move radially outwardly out of the recesses in the closing bolt and enter into corresponding recesses in the setting wheels.

A permutation lock of this type is disclosed in German Pat. No. 1 678 122.

The purpose of the present invention is to permit the user of such a permutation lock to change the position of the wheels representing the combination to an arrangement of numbers or other symbols which are familiar to the user.

In accordance with the present invention, the setting wheels are each formed of two parts in a known manner, one being an inner ring which acts on the locking pin and the other an outer ring which permits the movement of the setting wheel into a desired position. In normal use, the inner and outer ring rotate as a unit, however, in changing the combination the inner and outer rings can be rotated relative to one another.

The concept of using two-part setting wheels which can be locked or rotated relative to one another is known as disclosed in U.S. Pat. Nos. 2,136,493 and 1,604,866 and also in German Pat. No. 1 801 841.

The outer rings of each setting wheel are provided in a known manner with indicia, such as numbers or other symbols, for movement into position opposite a fixed index mark on the lock housing.

In preparation for changing the lock combination, the outer ring can be displaced axially relative to the corresponding inner ring from a first position for normal lock operation into a second position for changing the combination. In the second position the outer ring can be rotated relative to the inner ring. This feature is disclosed in the above-mentioned prior art and it is also known to effect the locking engagement of the rings by forming teeth on one of them and corresponding notches or recesses on the other. In the normal operation of the lock, the teeth and notches interengage, however, the teeth and notches can be disengaged when the combination is to be changed.

To avoid any accidental movement of the outer rings in the axial direction, the lock is constructed so that the inner rings of successive setting wheels in the axial direction are fixed between immovable first axial stops with the outer rings being fixed between second axial stops. One of the second axial stops, however, can be displaced in the axial direction between a first position representing the normal operation of the lock and a second position where the combination can be changed. When the axially movable second stop is displaced into the second position, the outer rings can be displaced axially from the corresponding inner rings for setting a new combination on the lock.

For simplifying the structure of the lock, it is preferable to locate the axially displaceable second stop adjacent the opening in the housing through which the closing bolt is inserted into the housing bore.

To facilitate problem-free use and a fool-proof selection of the combination, it is advisable that the axially displaceable second stop be locked in its normal operating position and in the position for changing the combination.

In a preferred and especially simple design of the permutation lock, the first stop for the inner rings is located adjacent to the opening to the bore in the housing into which the closing bolt is inserted. This first stop is in the form of a stop ring forced or shrunk onto the lock housing and the associated second stop is in the form of an annular cap engaged on this stop ring.

To prevent any change in the combination when the lock is in its normal operating locked position, the axially displaceable second stop is secured in the normal operating position on the housing by the closing bolt inserted into the bore in the housing.

While the combination is being changed, to prevent the inner rings from rotating with the outer rings so that the selection of the combination becomes uncontrollable, the axially displaceable second stop which has been moved into position for changing the combination is fixed by the released closing bolt which is retained in the bore in the lock housing. In this released position of the closing bolt, the locking pins are disengaged from the recesses in the closing bolt and, accordingly, are held radially outwardly within the release recesses of the inner rings with the locking pins preventing any rotation of the inner rings when the outer rings are rotated relative to the inner rings. The permutation lock embodying the present invention can be produced with all of the features and especially the safety-improving features in German Pat. Nos. 1 678 122 and 1 678 126. In accordance with German Pat. No. 1 678 122, it is possible to influence at least one of the locking pins by means of two adjacent inner rings. Based on German Pat. No. 1 678 122, it is also possible to provide the recesses in the closing bolt which receive the locking pins, with a rectangular cross sectional shape in a cross section taken along the axis. Further, the portions of the locking pins which engage in the recesses in the closing bolt can be provided with a cylindrically or prismatically shaped shank and the locking pins can be springbiased in the radially outward direction. Regarding these features, reference is made to the introduction to the specification in German Offenlegungsschrift No. 1 678 126.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
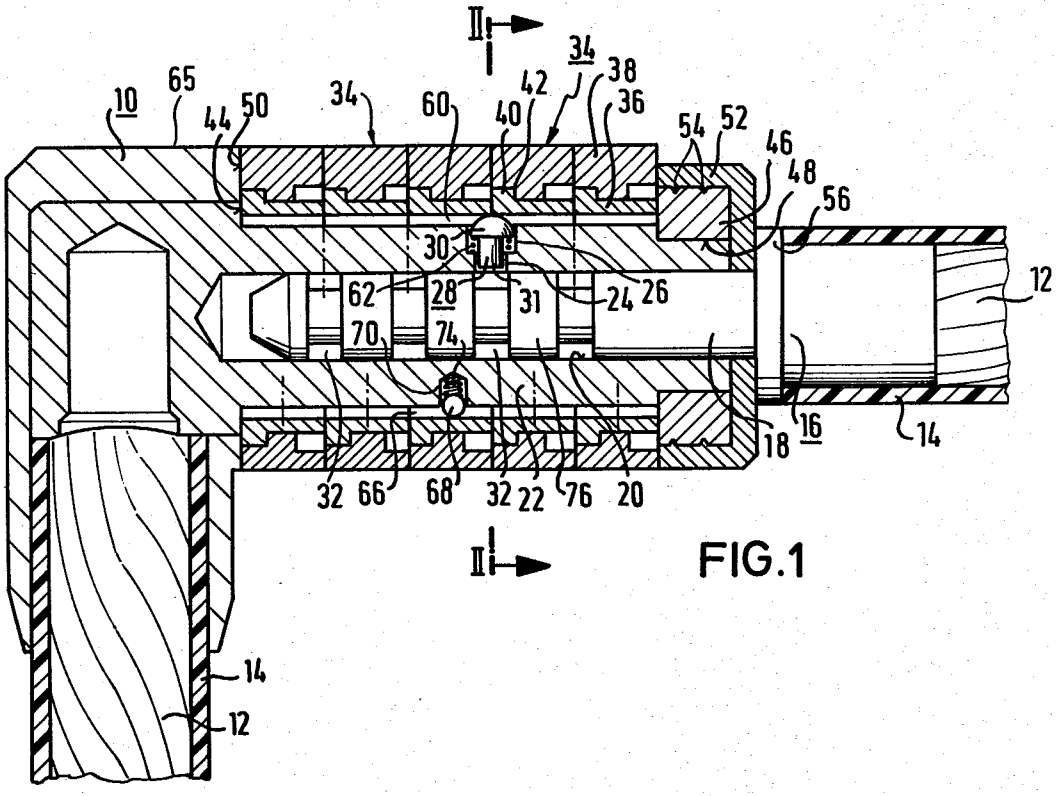
FIG. 1 is an axially extending cross sectional view of a cable permutation lock embodying the present invention.

In FIG. 1 a cable lock is illustrated having a lock housing 10 and a cable 12 secured within the housing. The cable 12 is covered with a protective sleeve 14. As viewed in FIG. 1, the left hand end of the cable 12 is anchored in the left hand end of the housing 10 while a closing bolt body 16 is secured to the right hand end of the cable. Only the ends of the cable 12 are illustrated, however, it should be appreciated that the cable is continuous between the illustrated ends. Closing bolt body 16 includes a closing bolt 18 inserted into a receiving bore 20 extending axially from the right hand end toward the left hand end of the housing 10. Blind bore 20 is formed in a tubular portion 22 of the lock housing 10. Radially extending openings 24 are formed through the tubular portion 22 from the bore 20 to the outer surface of the tubular portion. The openings 24 have an increased diameter in the radially outer portions. A locking pin 28 is positioned in each of the openings 24. The locking pins have hemispherically shaped heads 30 on the radially outer ends with cylindrically shaped shanks 31 extending from the heads inwardly toward the bore 20. Axially spaced annular locking pin recesses 32 are formed in the closing bolt 18 and align with the locking pins so that the radially inner ends of the locking pins can be moved radially inwardly into the recesses 32. As shown in FIG. 1, four locking pin recesses are spaced along the closing bolt. One locking pin 28 is assigned to each recess 32 with the shank 31 of the pin engaging a recess 32 in the closing bolt 18 when the closing bolt body 16 is in the position shown in FIG. 1.

Setting wheels 34 rotatably mounted on the tubular portion 22 of the housing 10 contact the heads 30 on the locking pins 28. Each of the setting wheels 34 consists of a radially inner ring 36 and a radially outer ring 38. The outer ring 38 is located on the outer surface of the cable lock and can be manipulated from outside the lock housing. In the position illustrated in FIG. 1, the inner rings 36 and the outer rings 38 are interengaged so that one cannot rotate relative to the other. Radially outwardly extending projections 40 extend outwardly from the outer surface of the inner rings 36 and engage in radially inner notches 42 in the radially inner surfaces of the outer rings 38. The arrangement of the projections 40 extending into the recesses 42 can be seen best in FIG. 2. The inner rings 36 are supported directly on the tubular portion 22 of the housing. The left hand one of the inner rings 36 bears against a stop shoulder 44 formed by the housing 10 while the right hand end one of the inner rings bears against a stop ring 46 which has been forced onto a step 48 formed in the right hand end of the tubular portion 22. Because of the fixed arrangement of the stop shoulder 44 and the stop ring 46, the inner rings 36 are held against movement in the axial direction of the tubular portion 22 of the housing 10. At the left hand end in FIG. 1, the outer rings abut against a stop surface 50 whle the right hand end of the rings bears against an annular cap 52 seated over the stop ring 46. Annular cap 52 is axially movable relative to the stop ring 46 between the normal operating position of the lock shown in FIG. 1 and a second position shifted to the right as compared to FIG. 1 for changing the lock combination. The exact location of each position is determined by the catch elements 54 on the cap 52 which cooperate with the stop ring 46. When the closing bolt 18 is in the locked position shown in FIG. 1, the annular cap 52 is fixed in the operating position between the right-hand end of the tubular portion 22 of the housing and the shoulder 56 on the closing bolt body 16. If, the locking action is released and the closing bolt is pulled out of the bore 20, the annular cap can be moved to the right into position for changing the combination. In this axially displaced position, the cap is held by the catch elements 54, however, in place of catch elements, the locking and axial adjustment of the annular cap can be provided by a bayonet catch or a threaded portion which can be screwed to a limited extent affording the axial displacement of the cap between its two positions.

When the annular cap is moved axially to the right from the position shown in FIG. 1 for changing the combination of the lock, the outer rings 38 can also be shifted to the right from the normal operating position illustrated in the drawing. In the shifted position, the radially outer projections on the inner ring 40 are no longer located within the radially inner notches 42 in the inner surfaces of the outer rings 38, accordingly, the outer rings can be rotated relative to the inner rings 36. The combination of the lock can be changed by a user as a result of this relative rotation. After the desired adjustment has been made, the outer rings 38 and the annular gap are moved axially in the leftward direction back into the normal operating position of the lock.

Release recesses are formed in the radially inner circumferential surface of the inner rings 36 with one recess 60 being provided in each of the inner rings. When the release recesses 60 coincide with a locking pin 28, the locking pin is moved radially outwardly into the release recess by the biasing action of a compression spring 62 which encircles the shank 31 of the locking pin causing the outward displacement of the locking pin from the recess 32 in the closing bolt 18. When all of the locking pins are displaced radially outwardly with their heads positioned within the recesses 60 in the inner rings 36, the closing bolt 18 can be removed from or inserted into the bore 20 in the tubular portion 22 of the housing 10. By adjusting the positions of the outer rings 38 relative to the inner rings 36, a large number of combinations can be set for effecting the releasing action of the lock. For example, when the closing bolt can be moved inwardly and outwardly, a user of the lock can change the number or indicia sequence on the outer rings in alignment with a radial projection 65 on the housing so that a sequence of numbers can be set as the combination which the user can easily remember.

The outer rings 38 can be locked on the tubular portion 22 in ten different angular positions. To establish each of these different positions, notches 66 are provided on the inner circumference of the inner rings 36, note FIG. 2. Catch balls 68 engage the notches 66. The catch balls 68 are each positioned in a blind bore 70 formed radially inwardly into the outer surface of the tubular portion 22. Each ball is biased radially outwardly by a compression spring 74. Due to the locking action effected on the inner ring 36, it is possible, when changing the combination, to rotate the outer rings 38 after the annular cap 52 and the outer rings 38 have been moved in the axial direction, without any danger of the inner rings 36 being rotated. Additional protection against accidental rotation of the inner rings 36 as the outer rings are rotated, involves the following:

When the annular cap 52 is moved to the right from the position in FIG. 1 into position for changing the combination, the closing bolt body is retained in position with its shoulder 56 bearing against the outer transverse surface of the annular cap 52 and, as a result, the ring-shaped lands 76 on the opposite sides of the recesses 32 engage the radially inner ends of the pins 28 so that the pins cannot move radially inwardly. With the locking pins 28 held in the radially outwardly displaced position, the inner rings 36 are secured against rotation. Accordingly, to ensure an absolutely reliable security against the rotation of the inner rings when the combination is being changed, it is only necessary to hold the shoulder 56 of the closing bolt body 16 against the transverse outer surface of the annular cap when it has been axially displaced into position for changing the combination.

It is to be noted, as is also the case in German Pat. No. 1 678 122, that two adjacent inner rings 36 receive or form the recess 60 in which one locking pin 28 is displaceable.

Figure 2:
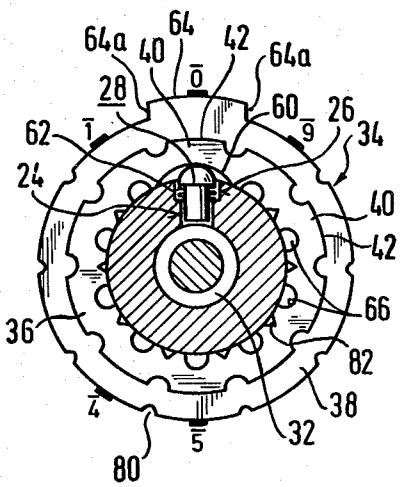
FIG. 2 is a cross sectional view taken along the line II—II in FIG. 1.

As can be seen best in FIG. 2, each outer ring 38 has a radial projection 64 which can be aligned with a similarly shaped radial projection 65 on the left-hand end of the housing 10. Each radial projection bears the number $\overline{0}$ with a crossbar extending across the top of the number. Numbers 1–9 are equiangularly spaced apart around the outer circumferential surface of the outer ring 38. The spacing between the numbers 0–9 corresponds to the spacing between the notches 66 on the inner circumference of the inner ring 36. The spacing of the numbers also corresponds to the spacing of the radially outwardly extending projections 40 on the outer circumference of the inner ring and the notches 42 on the inner circumference of the outer rings 38 into which the projections extend. The lock is used as follows:

The zero position of the lock is reached when all of the radial projections 64 on the setting wheels 34 are aligned with the radial projection 65 on the housing. In other words, when each of the numbers $\overline{0}$ of each radial projection 64 is aligned with one another on the radial projections 64 and with the index line on the radial projection 65, the lock is in its zero position. The zero position, however, is not the release position of the lock. On the contrary, the release position of the lock is established by the angular position of the inner rings 36 relative to the outer rings 38. Accordingly, to change the release position of the lock, that is the position where the closing bolt 18 can be removed from or inserted into the bore 20 in the tubular housing portion 22, the outer rings 38 must be rotated relative to the projection 65 until the release recesses 60 of the inner rings 36 corresponding to the outer rings 38 reach the location of the locking pins 28. The radial projections 64 are no longer in alignment with the radial projection 65 and a certain number of symbol sequence is aligned with the index mark on the radial projection 65. This particular number sequence is usually called the combination of the lock and in the release position corresponding to the combination, the closing bolt 18 can be removed from or inserted into the bore in the housing. Since the numbers 1–9 formed on the outer circumference of the outer ring are difficult to detect by touch or feel in the dark, additional detection notches 80 are formed in the outer circumferential surface of the outer ring. As can be seen in FIG. 2, these notches 80 are equidistantly spaced between a pair of adjacent numbers on the outer ring. At the radial projection 64, however, instead of the detection notches 80, the radial projections provide side surfaces **64*a*** which are easily detectable by feel when it is dark. Accordingly, when a person knows the combination, he can open the lock in the dark as follows:

Initially, all of the radial projections 64 on the setting wheels 34 are aligned with the radial projection 65 on the housing thus establishing the zero position of the lock. Subsequently by feeling the sides **64*a* and the detection notches 80 located around each setting wheel 34, by manipulating or turning the corresponding outer ring 38 around the axis of the bore in the housing, the number corresponding to the combination for that particular ring can be positioned in alignment with the index mark on the projection 65**.

The lock embodying the present invention has a high safety value resulting from the fact that the correct release positions of the setting wheels cannot be detected by touch. The detection by touch of the position of the individual setting wheels 34 for setting the combination and opening the lock is made more difficult by the following features:

(a) Since a pair of adjacent setting wheels 34, note FIG. 1, acts on each of the locking pins 28, accordingly one locking pin cannot be shifted radially outwardly by its associated spring 62 when only one of the setting wheels 34 is positioned with the combination number aligned opposite the index mark on the projection 65. If only one of the setting wheels is in the proper combination or release position, the locking pin 28 is still held in the radially inner position within the locking recess 32 in the closing bolt 18 by the other setting wheel. Accordingly, when the position of one of the setting wheels is reached in accordance with the selected combination, it is impossible to tell by listening if the locking pin slides outwardly. Further, no acceleration of the setting wheel can be detected by feel when the release recess 60 approaches the locking pin because of an acceleration provided by the radially outwardly biased locking pin 28 interacting with a side of one of the release recesses 60 and thereby imparting a certain circumferential force on the setting wheel.

(b) Another way of preventing the combination from being detected involves the interaction of the notches 66 on the inner circumferential surface of the inner rings 36 with the balls 68 located in the blind bores opening from the outer surface of the tubular housing portion 22. As can be seen in FIG. 1, the catch balls 68 are located exactly diametrically opposite the locking pins 28. Not only do the catch balls 68 fix the inner rings 36 when the outer rings are rotated relative to them when the comination is being changed, but, in addition, the catch balls have the effect that the angular positions of the setting wheels corresponding to a particular number in the combination series is exactly fixed. This feature is important for an exact interaction of the locking pin with the deepest point in the corresponding release recess 60. There is the additional effect that each catch ball and the corresponding catch notches superimpose the catch effect generated by the locking pins 28 in connection with the catch notches 66 and the release recess 60. As the setting wheel 34 is rotated, and its release recess 60 approaches the locking pin 28 there is a perceptibly different behavior than when a catch notch 66 approaches the locking pin 28. These different actions are caused by the different shapes of the catch notches 66 and the release recess 60. However, when a setting wheel 34 is rotated into the combination position, the effect which results from the interaction of the locking pin and the catch notches 66 or the release recess 60 is superimposed by the effect which results from the interaction of the catch balls 68 with the catch notches 66 and particularly the effect which occurs when the catch ball 68 reacts to a catch notch 66 when the locking pin 28 is being moved into the release recess. Since there is a superimposition of the reaction between the catch ball 68 and the catch notches 66 on the reaction between the locking pin 28 and the release recess 60 there does not appear to be any different feeling or effect as the locking pin moves into the release recess so that such movement cannot be perceived or felt.

(c) Another safety feature preventing the detection of the combination involves the arrangement of the intermediate notches 82 in the inner circumferential surface of the inner rings 36. Each of the intermediate notches is positioned approximately midway between two adjacent catch notches 66 and, therefore, engages the catch ball 68 during the rotation of one of the setting wheels 34, when the corresponding release recess 60 commences engagement with the locking pin 28. If the engagement of the locking pin 28 with the side of the release recess 60 could be felt as the setting wheel 34 is rotated, then such a possibility is avoided by the "drowning" of the engagement of the sides by the simultaneous engagement of the catch ball 68 in one of the intermediate notches 82.

(d) A further improvement in the safety of the lock embodying the present invention results, as can be seen from FIG. 1, from the cylindrical shape of the shanks 31 of the locking pins 28 and from the rectangular shape of the recesses 32 in the closing bolt 18, that is the shape of the recesses as viewed in section along the axis of the closing bolt. If someone attempts to determine the individual numbers of the lock combination by pulling on the closing bolt and simultaneously turning the setting wheels corresponding to a certain one of the locking pins in the hope that, when the release recesses of the corresponding setting rings are positioned in alignment with the locking pin, the locking pin will snap outwardly and, due to inaccuracies or tolerances in the finish of the bolt 18 and the housing 10, a small axial movement of the bolt under the pulling action will be noted which would indicate the particular combination numbers of the respective setting wheels. In the present invention, the possibility of success in such a procedure is made more difficult when a pulling force is placed on the closing bolt 18 due to the interaction of the sides of the recess 32 with the corresponding surfaces of the cylindrical shank 31 of the locking pin, radially outward movement of the locking pin is prevented until the pulling action on the closing bolt is removed. However, in this case, the axial mobility of the closing bolt can no longer be met.

(e) As can be seen in FIG. 1, viewed in the axial direction of the bore 20 through the tubular housing portion 22, the catch ball 68 is offset relative to the locking pin 28. This affords the possibility, not illustrated in FIG. 1, also to offset the catch notches 66 and the intermediate notches 82 relative to the release recesses 60 in the axial direction so that a catch notch 66 is located unchanged in that angular position at the inner circumference of the inner ring in which the release recess 60 for the locking pin 28 is arranged axially offset. As a result, the inner circumference of the inner ring can be completely smooth with the exception of the release recess 60 in the axially extending region in which the locking pin is located. Such an arrangement makes it even more difficult to detect the combination of the lock by fee.

While specific embodiments of the invention have been shown and described in detail to illustrate the application of the inventive principles, it will be understood that the invention may be embodied otherwise without departing from such principles.

What is claimed is:

1. Permutation lock comprising a lock housing having a first end and a second end spaced from said first end, said housing having an axially elongated bore therein extending from the first end toward the second end thereof and a plurality of openings spaced apart in the axial direction of said bore and extending in the radial direction relative to the axis of said bore from the inner surface to the outer surface of said housing, a locking pin movably displaceable in each of said openings, a plurality of setting wheels rotatably mounted on the outer surface of said housing through which said bore extends for movement around the axis of said bore, said setting wheels being arranged in side-by-side relation along the axial direction of said bore and each being rotatable relative to the others, said setting wheels having inwardly facing release recesses for receiving said locking pins, an axially extending closing bolt insertable into said bore along the axis thereof through the first end of said housing and having a plurality of locking recesses formed therein, said locking pins being movably displaceable into the recesses in said locking bolt, said setting wheels being rotatable into a release position representing the combination of said lock wherein said locking pins are released from the recesses in said closing bolt and move radially outwardly into said release recesses and said closing bolt is removable from and insertable into said bore and said wheels being rotatable from the release position for movably displacing said locking pins into the locking recesses in said closing bolt so that said closing bolt is secured within said bore, wherein the improvement comprises that each said setting wheel comprises a radially inner ring having said release recess therein and a radially outer ring located radially outwardly from said inner ring, and said inner ring and outer ring being lockable for rotatable movement as a unit and being displaceable from locked engagement for rotatable movement one relative to the other, said outer ring being axially displaceable relative to said inner ring from a first position wherein said outer ring operates in locked engagement with said inner ring to a second position where said outer ring can be rotated relative to said inner ring for changing the part of the combination of the lock associated with said setting wheel of which said outer ring forms a part, releasable securing means being provided for securing said outer ring in said first position, said securing means comprising a securing member provided on said closing bolt, said securing member securing said outer ring in said first position, when said closing bolt is locked in said bore, such that said outer ring is rotatable with respect to said inner ring only when said closing bolt is at least partially removed from said bore.

2. Permutation lock, as set forth in claim 1, including an index mark on said housing adjacent one end of said setting wheels, and indicia on said outer rings for alignment with said index mark for placing said setting wheels in position representing the combination of the lock.

3. Permutation lock, as set forth in claim 1, including first axial stop means located at the opposite ends of said setting wheels on said housing for fixing said inner rings of said setting wheels so that said inner rings are secured against axial movement, and second axial stop means located at the opposite ends of said setting wheels on said housing for fixing said outer rings of said setting wheels so that the outer rings are secured against axial movement, a part of said second axial stop means being axially displaceable from a first position for preventing axial movement of said outer rings to a second position permitting axial displacement of said outer rings relative to said inner rings so that the combination of the lock can be changed by rotating said outer rings relative to said inner rings, said part of said second axial stop means being secured in said first position by said securing member.

4. Permutation lock, as set forth in claim 3, wherein said second axial stop means comprises a first outer ring stop located at said first end of said lock housing, said first outer ring stop being displaceable from a first axial position in the axial direction of said bore in said housing for movement into a second axial position for rotating said outer ring relative to said inner ring, said first outer ring stop being locked against axial displacement by said securing member in said first axial position.

5. Permutation lock, as set forth in claim 4, including positioning means for positioning said first outer ring stop in said second axial position.

6. Permutation lock, as set forth in claim 5, wherein said first axial stop means comprises a first inner ring stop located at said first end of said lock housing, said first inner ring stop comprising a stop ring in a force fit engagement with said lock housing, said first outer ring stop comprises an annular cap enclosing said stop ring in closely fitting engagement.

7. Permutation lock, as set forth in claim 6, wherein said securing member extends out of said bore in the locked position of said closing bolt within said housing.

8. Permutation lock, as set forth in claim 7, wherein said first inner ring stop is secured on said housing in the first position for normal lock operation through said first outer ring stop by said closing bolt when said closing bolt is locked within said bore.

9. Permutation lock, as set forth in claim 5, wherein with said first outer ring stop in position for rotating said outer rings relative to said inner rings and said locking pins displaced radially outwardly from said locking recesses in said closing bolt into said release recesses in said inner rings, the outer surface of said closing bolt is shaped between said locking recesses so that with said closing bolt retained in said bore and with said securing member of said closing bolt in contact with said first outer ring stop the outer surface of said closing bolt holds and locking pins in said release recesses for preventing rotation of said inner rings during rotation of said outer rings relative to said inner rings.

10. Permutation lock, as set forth in claim 1, wherein said locking recesses in said closing bolt have a rectangular shaped cross section taken along and through the axis of said closing bolt, each said locking pin having a cylindrically shaped shank positionable within one of said locking recesses, and spring means acting on said locking pins and biasing said locking pins radially outwardly.

11. Permutation lock as set forth in claim 1, wherein two adjacent said inner rings in combination contact at least one said locking ring so that the two adjacent said inner rings act in concert in influencing said outer ring and in forming said release recess into which said locking ring is outwardly displaceable.

12. Permutation lock, as set forth in claim 1, wherein each said inner ring having a plurality of notches spaced angularly apart around the inner circumferential surface thereof with the combination of said notches and said release recess being equidistantly spaced apart, said housing having a blind bore extending radially inwardly from the outer surface thereof aligned opposite each of said inner rings, a catch member movably displaceably positioned within each of said radially extending blind bores, means within said blind bore for biasing said catch members radially outwardly so that each said catch member engages within one of said notches in said inner ring for holding said inner ring in a particular angular position, an intermediate notch formed in the inner circumferential surface of said inner ring between each adjacent pair of said notches so that one of said intermediate notches of each said inner ring interacts with said catch member corresponding to the same said inner ring as said locking pin moves relative to said release recess in the same said inner ring.

13. Permutation lock as set forth in claim 12, wherein in each said setting wheel the associated said catch member is offset in the axial direction relative to said locking pin associated therewith.

14. Permutation lock as set forth in claim 13, wherein in each said inner ring said release recess therein is offset in the axial direction of said bore in said housing relative to said catch notches in the same said inner ring so that in the axial extent of said release recess the remainder of the inner circumferential surface of said inner ring comprises a smooth cylindrical shape, and in the axial extent of said inner circumferential surface of said inner ring containing said catch notches there is one said catch notch aligned in the axial direction with said release recess.

* * * * *